United States Patent [19]

Newton et al.

[11] 4,171,249

[45] Oct. 16, 1979

[54] IMPROVEMENTS IN OR RELATING TO CIRCULATING BED ELECTRODES

[75] Inventors: Alan F. R. Newton, Portsmouth; Kendrick P. Haines, Havant; David Harrison; John F. Davidson, both of Cambridge, all of England

[73] Assignee: Parel Societe Anonyme, Luxembourg

[21] Appl. No.: 887,769

[22] Filed: Mar. 17, 1978

[30] Foreign Application Priority Data

Mar. 17, 1977 [GB] United Kingdom ..... 11493/77

[51] Int. Cl.[2] ..... C25C 1/00; C25C 7/00; C25C 7/02

[52] U.S. Cl. ..... 204/105 R; 204/108; 204/222

[58] Field of Search ..... 204/222, 105 R, 108

[56] References Cited

U.S. PATENT DOCUMENTS

| | | | |
|---|---|---|---|
| 3,945,892 | 3/1976 | James et al. | 204/1 R |
| 3,974,049 | 8/1976 | James et al. | 204/106 |
| 3,981,787 | 9/1976 | James et al. | 204/252 |
| 4,065,375 | 12/1977 | Newton | 204/237 |
| 4,073,707 | 2/1978 | Spaziante et al. | 204/105 R |

*Primary Examiner*—R. L. Andrews
*Attorney, Agent, or Firm*—Armstrong, Nikaido, Marmelstein & Kubovcik

[57] ABSTRACT

An electrochemical cell is disclosed which includes a particulate electrode and a current conductor for feeding current to the particles of the particulate electrode, and means for flowing a fluid medium upwardly through the said particulate electrode, wherein a wall which forms part of a compartment defining the area occupied by the particulate electrode is provided with stabilizing means positioned so as to provide generally unidirectional flow channels which, when the electrochemical cell is in use, encourage vertical flow, and discourage bulk lateral movement, of said particles in the region of the said wall. There is also disclosed an electrochemical process in which there is used a particulate electrode located in an electrochemical cell or a compartment of an electrochemical cell, and in which a fluid is supplied to the particulate electrode so as to cause the majority of the particles which constitute the particulate electrode to undergo systematic circulatory movement within the cell or the compartment of a cell, wherein the motion of the particles is controlled at least in part by the provision of stabilizing means on a wall defining part of the area occupied by the particulate electrode, the stabilizing means being shaped and positioned so as to provide generally unidirectional flow channels which encourage vertical flow and discourage bulk lateral movement of the particles in the region of the said wall.

41 Claims, 7 Drawing Figures

IMPROVEMENTS IN OR RELATING TO CIRCULATING BED ELECTRODES

BACKGROUND OF THE INVENTION

This invention relates to electrochemical processes and apparatus and more particularly is concerned with such processes and apparatus employing circulating bed electrodes.

Circulating bed electrodes are particularly valuable for use as the cathode in metal electrodeposition reactions. Apparatus and processes involving or capable of operating with circulating bed electrodes are described and claimed in our British Pat. Nos. 1,485,301; 1,483,464; 1,497,543; and 1,481,663; and in our U.S. Pat. Nos. 3,974,049; 3,981,787; 3,945,892; 4,073,707; and 4,065,375.

A circulating bed electrode consists of a bed of electroconductive particles which are caused to circulate within a predetermined region of an electrode compartment or cell; it is particularly desirable for the circulation pattern to be stable. A circulating bed electrode differs from a fluidised bed electrode in that particles in the latter do not follow a systematic circulation pattern, but move randomly within the bed. Circulating bed electrodes may be used in electrosynthesis and electrodeposition reactions.

SUMMARY OF THE INVENTION

According to one aspect of the present invention, there is provided an electrochemical cell including a particulate electrode and a current conductor for feeding current to the particles of the particulate electrode, and means for flowing a fluid medium upwardly through the said particulate electrode, wherein a wall which forms part of a compartment defining the area occupied by the particulate electrode is provided with stabilising means positioned so as to provide generally unidirectional flow channels which, when the electrochemical cell is in use, encourage vertical flow, and discourage bulk lateral movement, of said particles in the region of the said wall.

According to another aspect of the present invention, there is provided an electrochemical process in which there is used a particulate electrode located in an electrochemical cell or a compartment of an electrochemical cell, and in which a fluid is supplied to the particulate electrode so as to cause the majority of the particles which constitute the particulate electrode to undergo systematic circulatory movement within the cell or the compartment of a cell, wherein the motion of the particles is controlled at least in part by the provision of stabilising means on a wall defining part of the area occupied by the particulate electrode, the stabilising means being shaped and positioned so as to provide generally unidirectional flow channels which encourage vertical flow and discourage bulk lateral movement of the particles in the region of the said wall.

DESCRIPTION OF THE PREFERRED EMBODIMENTS

Advantageously, the particulate electrode is bounded on one side by a separator having an ion-permeable wall and on the side opposite said one side by said wall which is provided with the stabilising means. The means for flowing fluid upwardly through the particulate electrode will generally include a flow distributor through which, for example, electrolyte is introduced into the compartment containing the particulate electrode; such a flow distributor can have a plurality of orifices, e.g. uniformly arranged or uniformly spaced apart, debouching into the said compartment.

One circulation pattern which has been found to be satisfactory is such that the majority of the electroconductive particles are caused to move within the electrode compartment or cell or flow paths which include an upward movement in which the majority of said particles travel upwardly through a first region (within which the average number of particles per unit volume is preferably relatively low) and a downward movement in which the majority of particles travel downwardly through a second region (within which the average number of particles per unit volume is preferably relatively high). Particles travel along paths and so circulate through these first and second regions. In practice, in preferred embodiments in which an ion-permeable wall separates the particulate electrode from a further cell compartment containing a counter-electrode, it has been found to be advantageous for the first region to be adjacent to the ion-permeable wall and for the second region to be spaced from the ion-permeable wall. Circulation in the desired manner may be achieved by injecting a fluid medium, generally an electrolyte, into the base of the electrode compartment so as to entrain particles; the fluid medium is advantageously caused to flow upwardly adjacent the ion-permeable wall. In addition, at least a part of the ion-permeable wall is advantageously inclined in the upward direction towards the particulate electrode. Preferably, the ion-permeable wall is inclined to the vertical at an angle of from 1° to 45° in the upward direction towards and so as to overlie the mass of particles. This arrangement may be achieved by employing a generally rectangular cell which, in operation, is held at an angle to the vertical which will generally be in the range of from 1° to 45°. The angle formed between the vertical and that part of the ion-permeable wall which, in operation, is adjacent to the circulating bed electrode is hereinafter termed the angle of tilt.

Advantageously, the volume, within the electrode compartment or cell containing the particulate electrode, which is occupied during the process of this invention is less than 20% greater, and preferably from 8% to 12% greater, than the volume that would be occupied by a static, settled bed of the particles.

The mass of discrete, electroconductive particles can constitute a cathode or an anode; the process of the invention can be employed with advantage to achieve the electrodeposition of one or more species of metallic ion onto a particulate cathode. Many other applications of the process may also be practised.

With appropriate construction and operation of an electrochemical cell of the invention in which a particulate cathode is employed, a continuous uniform rising curtain of electrolyte and particles may be achieved over the full width and height of the ion-permeable wall which separates the anode and cathode compartments; concurrently, particles of the circulating bed descend down the back face of the cathode compartment remote from the ion-permeable wall in a relatively thick and uniform layer. This configuration has been found to be effective in preventing particle agglomeration and, more importantly, in preventing metal deposition on the face of the ion-permeable wall with which the electrode is in contact. The configuration, however, may be sensitive to changes in process conditions and for any given conditions it may be the case that only one angle of tilt and one flow rate of electrolyte are suitable to give optimum operating conditions. It is undesirable for the rising curtain of particles to become unstable and for static areas of bed to form at the ion-permeable wall, since this has the result that metal is deposited on the ion-permeable wall.

Changes in the electrolyte flow rate, the angle of tilt, the electrolyte temperature, particle size of the particles within the bed, their specific gravity, and the viscosity of the electrolyte all affect the circulation pattern which is set up within the bed under a given set of conditions and, in particular, affect the stability of the rising curtain of particles. However, with the stabilising means used in the present invention, it is possible, by stabilising the descending bed of particles, to achieve a stable rising curtain of particles along the ion-permeable wall which curtain of particles remains stable over a wider range of variation of the parameters mentioned above. In particular, the flow pattern is more stable with respect to change in electrolyte flow rate, angle of tilt and size distribution of the particles which constitute the particulate bed.

The stabilising means can be provided in or on a wall which is electrochemically inactive; alternatively, the wall can include areas which are electrochemically active, for example the current conductor(s) can form part of the wall.

The stabilising means advantageously extend over at least 50% of the height of the wall in or on which they are located; this will generally correspond to 50% of the height of the bed of particles that constitute the particulate electrode (that is, in preferred embodiments, at least half of the separation between the flow distributor and the top of the bed where the particles disengage from the upwardly flowing electrolyte in the first region adjacent to the ion-permeable wall). The stabilising means (which may also be termed bed stabilisers) can, conveniently, be in the form of strips or ribs of material secured to, and raised from the general surface level of, a wall of the cell or compartment defining the area occupied by the particulate electrode; in preferred embodiments, this wall generally will be opposite the ion-permeable wall and may be parallel thereto or make an angle of 45° or less, preferably 30° or less, with the plane of the ion-permeable wall. The wall can be planar, curved about a horizontal axis or can consist of a plurality of planar portions set at an angle with respect to each other. The strips or ribs of material can be of various cross-sectional shapes, for example triangular, arcuate (e.g. semi-circular or semi-elliptical) or cuspid; triangular and cuspid cross-sections with an apex or cusp directed into the interior of the compartment are presently preferred. The ribs are preferably formed with chamfered ends so as to prevent build up of particles at the upper and lower ends of the ribs. The ribs can be in the form of a series of linear, parallel strips.

In one embodiment, the bed stabilisers are in the form of a plurality of vertical ribs equally spaced apart across the width of the wall and preferably of uniform length. In another embodiment, the bed stabilisers are in the form of a plurality of vertical ribs arranged in rows, the ribs of any given row preferably being staggered (i.e. offset) with respect to the ribs in adjacent rows above and below the given row. In a third embodiment, the bed stabilisers are in the form of sinuous strips extending generally vertically on the wall. A series of such strips may be spaced equally; or other arrangements may be adopted. The configuration of the ribs in the second and third embodiments is believed to provide a certain degree of mixing of the particles of the bed when the range of particle sizes present is quite large. When there is a relatively large range of particle sizes present in the bed, it is possible for the smaller particles to percolate between the larger particles and segregation may then result. The arrangements of ribs in the second and third embodiments are believed to reduce this tendency to segregate by promoting mixing laterally at the wall and perpendicularly to the wall. The degree of mixing effected is not such as to influence the bed as a whole, but rather acts on a local scale within the bed; the generally vertical extent of the ribs inhibits lateral motion of the bed as a whole. Thus the ribs prevent macro-circulation of the particles constituting the bed in a horizontal plane while promoting intermixing of particles in a generally vertical plane.

Instead of employing strips of material attached to the wall, the bed stabilisers may be integrally formed in the back wall by any suitable technique.

The electrochemical cell of this invention can comprise a first electrode compartment containing a counter electrode, a second electrode compartment containing the particulate electrode and the current feeder therefor, said first and second electrode compartments being separated by a separator having an ion-permeable wall, and means for flowing a fluid medium upwardly through said second electrode compartment adjacent the ion-permeable wall and in contact with the particulate electrode. In such a cell, bed stabilisers will generally be provided in that wall of the second electrode compartment opposite the ion-permeable wall. For convenience, this wall will hereinafter be referred to as the back wall.

Where the flow distributor comprises a plurality of orifices through which electrolyte or other fluid medium debouches, it may be convenient, in the first embodiment mentioned above, for the spacing between adjacent ribs on the back wall to be approximately twice that between adjacent orifices in the flow distributor. It may be undesirable for any of the vertical ribs to be disposed directly above an orifice of the flow distributor.

BRIEF DESCRIPTION OF THE DRAWINGS

For a better understanding of the invention, and to show how the same may be carried into effect, reference will now be made, by way of example, to the accompanying drawings, in which:

Referring to the drawings, the electrochemical cell comprises a first or anodic compartment 2 and a second or cathodic compartment 4 separated by an ion-permeable wall 6. A counter electrode (anode) 8 is present in the anode compartment 2, and the cathode consists of a bed of electroconductive particles 10 to which current is supplied by a current feeder 12. A flow distributor 14 is located at the base of the cathode compartment and includes a plurality of channels 16 to which electrolyte is supplied via an inlet and predistributor 18. In the arrangement illustrated in FIGS. 1 to 4, the channels 16 debouch at orifices inclined with respect to the planes containing the ion-permeable membrane 6 and the back wall 22 of the cathode compartment. As seen in FIG. 3, the channels 16 make an angle of 25° with the planes containing the ion-permeable wall and the back plate 22. In operation, the electrochemical cell is tilted at an angle from the vertical which is generally of from 1° to 45°, more commonly from 10° to 30°. This general arrangement can be seen from FIG. 1. The flow of electrolyte through the flow channels 16 entrains the electroconductive particles which constitute the cathode, and results in a circulation of these particles as indicated generally by the arrows in FIG. 1. It can be seen from this Figure that there is a first region 24 which is adjacent the ion-permeable wall 6 and which contains a relatively small number of particles per unit volume which are moving in a generally upwardly direction entrained with electrolyte, and a second region 26 which is adjacent the back wall 22 and which contains a relatively large number of particles per unit volume which are descending from the top of the circulating bed towards the outlet of the flow distributor channel 16. In operation, the particles present in the first region 24 give the appearance of a rising curtain of particles. In contrast, the descending particles in the region 26 tend to move more slowly and most of the particles are in contact with other particles.

Figure 2:
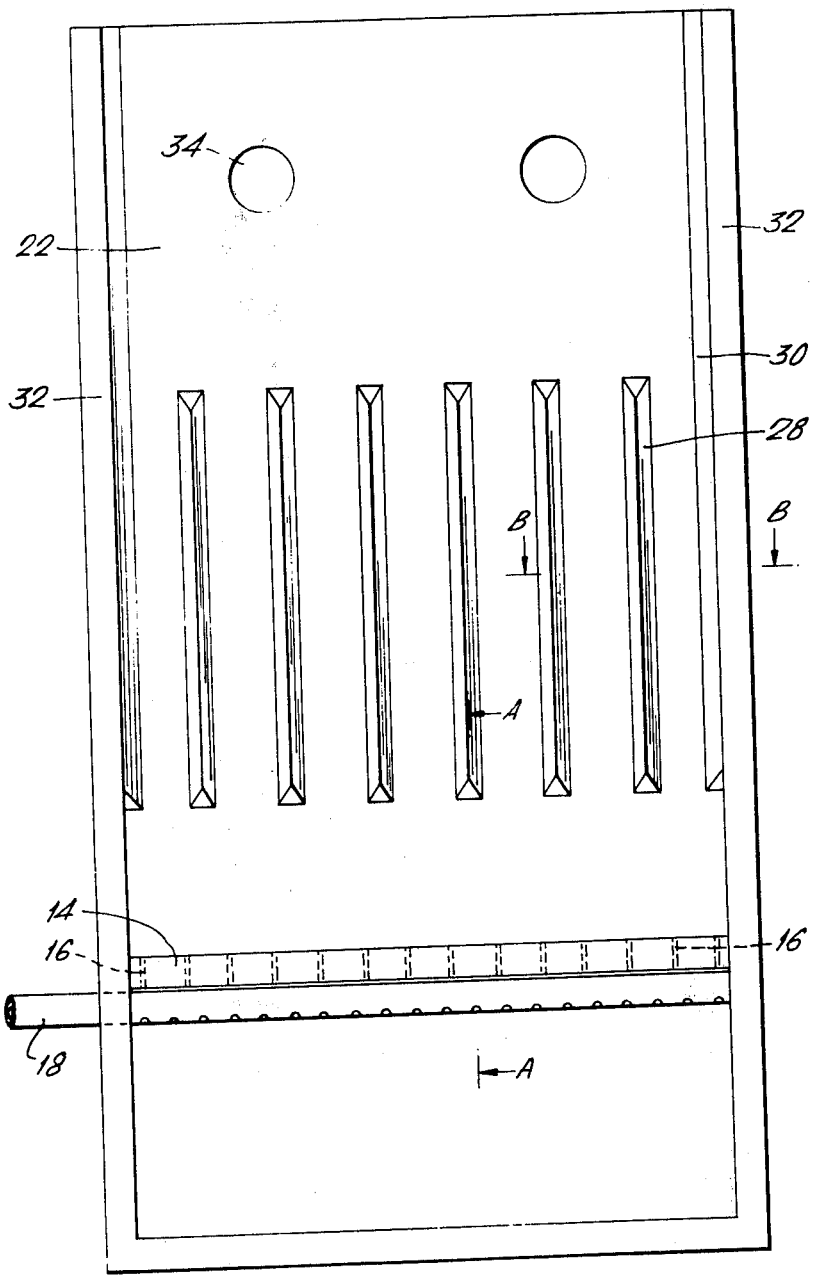
FIG. 2 is an elevational view of part of the electrochemical cell shown in FIG. 1 and illustrating one arrangement of bed stabilisers.

As can be seen in FIG. 2, there are six vertical ribs 28 provided on the back wall 22 of the cathode compartment. The ribs are equally spaced from one another, the separation between the centre points of adjacent ribs being 74 mm. Corner fillets 30 are provided in the corners between the back wall 22 and the side walls 32 of the cathode compartment. The ribs 28 are each 335 mm in height. Each rib is positioned between two flow distributor channels 16 when viewed from above. The separation between the side walls 32 and the nearest of the series of vertical ribs 28 is 55 mm. In operation, there is a net upward flow of electrolyte from the distributor channels 16 (of which there are fourteen) to electrolyte outlets 34 situated near the top of the cathode compartment.

Figure 3:
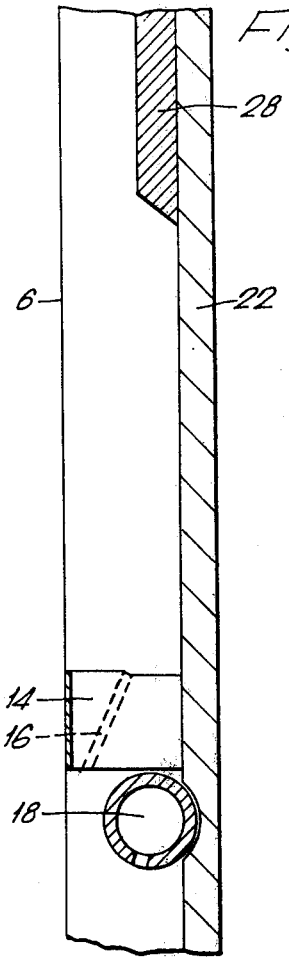
FIG. 3 is a section along the line A—A of FIG. 2.
Figure 4:
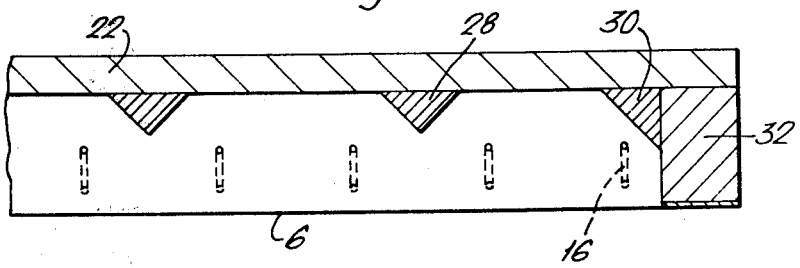
FIG. 4 is a section along the line B—B of FIG. 2.

The ribs 28 are triangular in cross-section as can be seen from FIG. 4. They have chamfered ends as shown in FIGS. 2 and 3.

Figure 5:
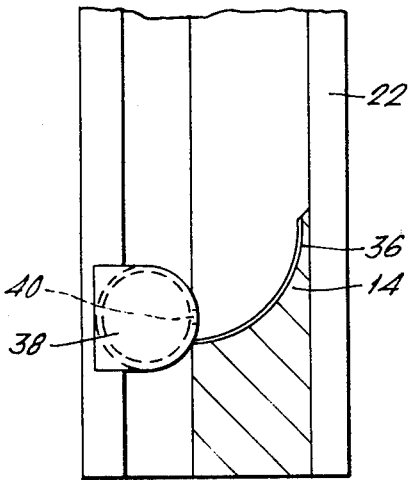
FIG. 5 is a vertical section through part of an electrochemical cell employing an alternative flow distributor to that shown in FIG. 1.

Referring now to FIG. 5, there is shown a sectional view through the lower portion of an electrochemical cell having an alternative form of flow distributor 14. The flow distributor consists of a curved plate 16 which cooperates with an electrolyte feeder 38 having a plurality of orifices 40. Each orifice 40 is located a distance X above the lower portion of the curved plate 36. In the embodiments illustrated, the radius of curvature of the plate 36 is 28.8 mm, and the orifices 40 are 10 mm above the lowermost portion of the curved plate 36.

Figure 6:
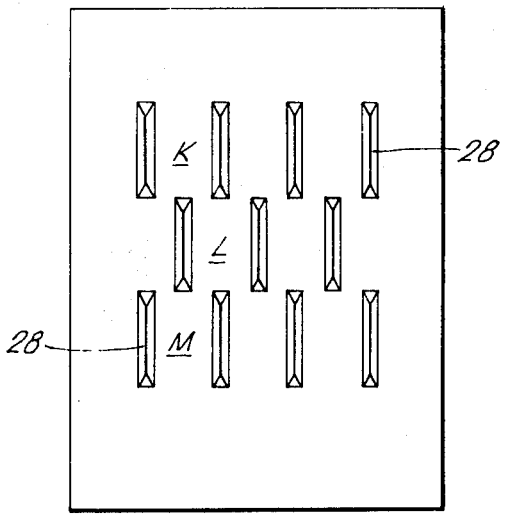
FIGS. 6 and 7 illustrate other embodiments of this invention.

Referring now to FIG. 6, there is shown an arrangement in which the bed stabilisers consist of a plurality of ribs 28 arranged in three rows K, L and M in a staggered formation (i.e. the ribs in any given row are offset with respect to the ribs in adjacent rows). The ribs are triangular in cross-section and have chamfered ends.

Figure 7:
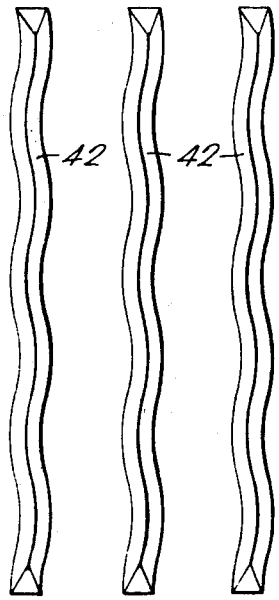

Referring now to FIg. 7, there is shown an arrangement in which the bed stabilisers consist of sinuous strips 42. The strips are triangular in cross-section and have chamfered ends. Although only three such strips are shown in FIG. 7, more than this number may be used in practice. The strips in this embodiment are "parallel", that is a tangent drawn at any given point on any one of the strips will be parallel to the tangents to all the other strips drawn at points the same vertical distance above the base of the wall as for the given point on the first mentioned strip. Other arrangements may, however, be employed.

The invention will be further illustrated by the following examples, in which the bed stabilisers were as shown in FIG. 2; the circulating bed electrode consisted of particles of copper; and the electrolyte contained 15 grams per litre copper (as copper sulphate) and 10 grams per litre sulphuric acid. The particle size distribution of the copper particles was one of three types characterised as below:

| BED TYPE 1 - MIXED LARGE | |
|---|---|
| Size Range | % by Weight |
| 300–500 μm | 3.75 |
| 500–600 μm | 3.125 |
| 600–710 μm | 5.0 |
| 710–850 μm | 8.75 |
| 850–1000 μm | 14.375 |
| 1000–1200 μm | 24.375 |
| 1200–1400 μm | 40.625 |

| BED TYPE 2 - MIXED SMALL | |
|---|---|
| Size Range | % by Weight |
| 300–500 μm | 25 |
| 500–600 μm | 25 |
| 600–710 μm | 25 |
| 710–850 μm | 25 |

| BED TYPE 3 - MIXED FINES | |
|---|---|
| Size Range | % by Weight |
| 150–180 μm | 2.0 |
| 180–210 μm | 3.2 |
| 210–250 μm | 5.1 |
| 250–295 μm | 8.7 |
| 295–355 μm | 14.2 |
| 355–420 μm | 24.5 |
| 420–500 μm | 42-3 |

EXAMPLE 1

Tests were carried out with a circulating bed electrode of type 2 and a flow distributor as shown in FIG. 5 of the accompanying drawings. The electrolyte distributor 38 was provided with 14 outlet holes each of 3 mm diameter, the spacing between the centre lines of adjacent holes being 37 mm.

A very good flow pattern was obtained at a 30° angle of tilt and with the electrolyte flow rate between 1.4 and 2.0 $m^3$ per hour, and also between 3.3 and 3.5 $m^3$ per hour. The flow pattern became unstable when the electrolyte flow rate was in the range 2.2 to 3.2 $m^3$ per hour.

EXAMPLE 2

Figure 1:
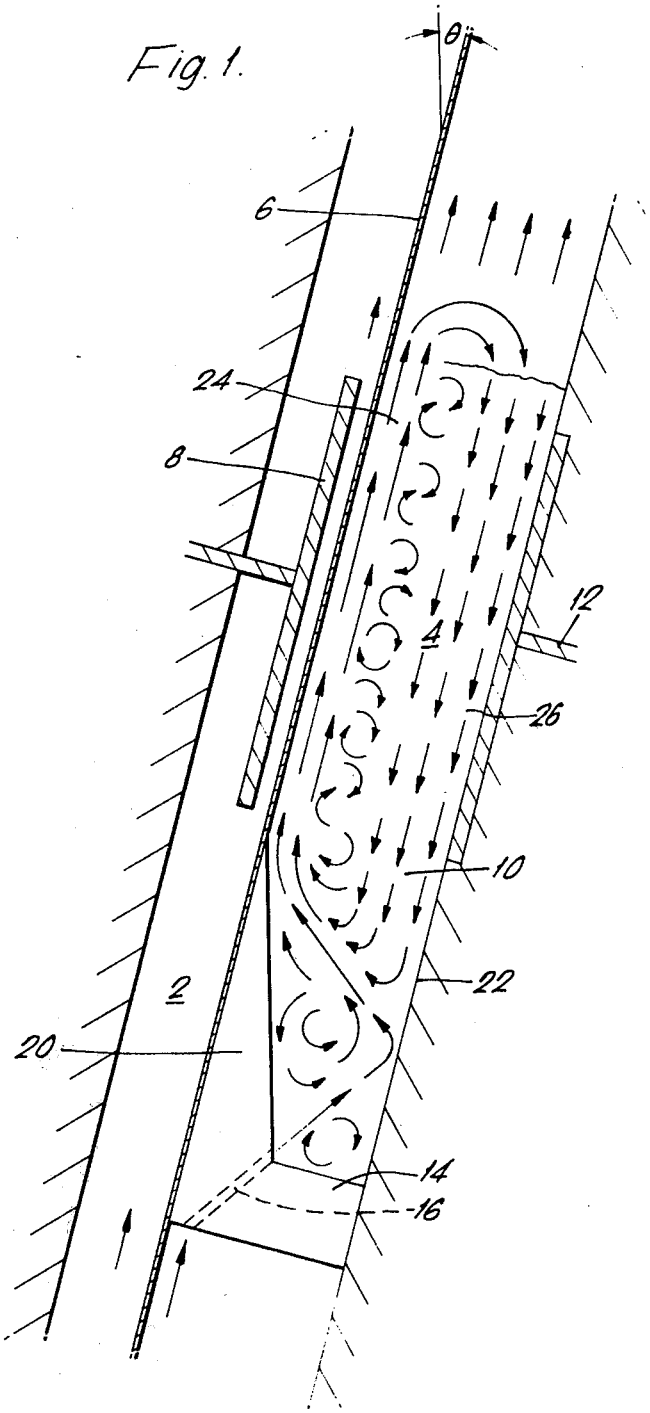
FIG. 1 illustrates schematically a vertical section through an electrochemical cell having a flow distributor of the type described in our British Pat. No. 1,497,543 and our U.S. Pat. No. 4,065,375.

Tests were carried out with an electrochemical cell having a flow distributor as shown generally in FIGS. 1 and 2; there being fourteen distributor channels 16 each debouching at an orifice of 2.5 mm diameter the centre lines of the orifices being spaced apart by 37 mm. The flow distributor channels 16 made an angle of 25° with the plane containing the ion-permeable wall 6. The predistributor 18 consisted of a pipe having 20 outlet holes each 5 mm in diameter with their centre lines spaced 25 mm apart. Particulate cathodes of each of types 1, 2 and 3 were used and the angle of tilt of the cell was varied in each case. A particulate cathode of each of the three bed types was employed in the tests.

Good flow patterns were obtained with an angle of tilt in the range from 15° to 25° with a particulate electrode of bed type 1. At 15°, the acceptable flow range was 1.83 to 2.20 $m^3$ per hour, and at 25° it was 1.82 to 2.60 $m^3$ per hour. When the angle of tilt was increased above 25°, it was found that the flow pattern rapidly degenerated. In the tests with bed type 2, good flow patterns were obtained between 20° and 30° angle of tilt. At 20°, the flow range was 0.2 to 1.1 $m^3$ per hour and at 30° it was 0.9 to 1.7 $m^3$ per hour. With bed type 3, the circulation patterns were only acceptable at an angle of tilt of 30°. At angles of tilt less than 30°, unsatisfactory flow patterns were obtained because of interference between the flow distributor channel 16 and the vertical ribs 28.

EXAMPLE 3

Comparative tests were carried out which corresponded to the tests described above in Example 2 except that no vertical ribs 28 were present on the back wall 22 of the cathode compartment. The results obtained showed that the acceptable flow range for an angle of tilt of from 15° to 25° was within the range 1.95 to 2.15 $m^3$ per hour. These tests showed that the presence of vertical ribs resulted in an increase in the acceptable flow range of 100% when the angle of tilt was 15°, and of 420% when the angle of tilt was 25°, for comparable beds of particles.

We claim:

1. An electrochemical process for electrowinning, electrorecovering, or electrorefining a metal by applying an electrolysis current in which there is used a particulate electrode located in an electrochemical cell or a compartment of an electrochemical cell, and in which a fluid is supplied to the particulate electrode so as to cause the majority of the particles which constitute the particulate electrode to undergo systematic circulatory movement within the cell or the compartment of a cell, wherein the motion of the particles is controlled at least in part by the provision of stabilising means on a wall defining part of the area occupied by the particulate electrode, the stabilising means being shaped and positioned so as to provide generally unidirectional flow channels which encourage vertical flow and discourage bulk lateral movement of the particles in the region of the said wall.

2. An electrochemical process as claimed in claim 1, wherein the majority of said particles are caused to undergo circulatory movement within the cell or compartment involving flow paths which include an upward movement in which the majority of said particles travel upwardly through a first region of the cell or compartment; and a downward movement in which the majority of said particles travel downwardly through a second region of the cell or compartment.

3. A process according to claim 2, wherein the circulation of electroconductive particles is such that in said first region the average number of particles per unit volume is relatively low, and in said second region the average number of particles per unit volume is relatively high.

4. A process according to claim 3, in which an ion-permeable wall separates the particulate electrode from a further cell compartment which contains a counter-electrode.

5. A process according to claim 4, wherein said first region is adjacent to the ion-permeable wall and said second region is spaced apart from the ion-permeable wall.

6. A process according to claim 5, wherein said ion-permeable wall is inclined to the vertical at an angle of from 1° to 45° in the upward direction towards and so as to overlie the mass of particles.

7. A process according to claim 6, wherein the fluid medium is introduced into a lower portion of the mass of particles and is directed upwardly to flow adjacent the ion-permeable wall.

8. A process according to claim 1, in which an ion-permeable wall separates the particulate electrode from a further cell compartment which contains a counter-electrode.

9. A process according to claim 8, wherein the fluid medium is introduced into a lower portion of the mass of particles and is directed upwardly to flow adjacent the ion-permeable wall.

10. A process according to claim 1, wherein the volume, within the electrode compartment or the cell containing the particulate electrode, which is occupied by the particles during the process is less than 20% greater than the volume that would be occupied by a static, settled bed of said particles.

11. A process according to claim 10, wherein the volume occupied by said particles is in the range of from 8% to 12% greater than that occupied by a static, settled bed of said particles.

12. A process according to claim 1, wherein said mass of discrete, electroconductive particles constitutes a cathode.

13. A process according to claim 12, which comprises the electrodeposition of at least one species of metallic ion on to said particles.

14. An electrochemical process for electrowinning, electrorecovering, or electrorefining a metal by applying an electrolysis current in which there is used a particulate electrode located in a first compartment of an electrochemical cell separated from a second compartment of the electrochemical cell containing a counter-electrode by a separator including an ion-permeable wall, and in which a fluid is supplied to the particulate electrode so as to cause the majority of the particles which constitute the particulate electrode to undergo systematic circulatory movement within the compartment of the cell involving flow paths which include an upward movement in which the majority of said particles travel upwardly through a first region of the compartment adjacent to the ion-permeable wall, and a downward movement in which the majority of said particles travel downwardly through a second region of the compartment spaced apart from the ion-permeable wall, the average number of particles per unit volume being higher in said second region than in said first region, wherein the motion of the particles is controlled at least in part by the provision of stabilising means in the form of a plurality of uniformly spaced apart ribs on a wall opposite said ion-permeable wall and adjacent to said second region, the stabilising means being shaped and positioned so as to provide generally unidirectional flow channels which encourage vertical flow and discourage bulk lateral movement of the particles in said second region.

15. A process according to claim 14, wherein said ion-permeable wall is inclined to the vertical at an angle of from 1° to 45° in the upward direction towards and so as to overlie the mass of particles.

16. A process according to claim 15, wherein the fluid medium is introduced into a lower portion of the mass of particles and is directed upwardly to flow adjacent the ion-permeable wall.

17. A process according to claim 16, wherein the volume, within the electrode compartment containing the particulate electrode, which is occupied by the particles during the process is from 8% to 12% greater than the volume that would be occupied by a static, settled bed of said particles.

18. A process according to claim 14, wherein said mass of discrete, electroconductive particles constitutes a cathode.

19. A process according to claim 18, which comprises the electrodeposition of at least one species of metallic ion on to said particles.

20. An electrochemical cell including a particulate electrode and a current conductor for feeding current to the particles of the particulate electrode, and means for flowing a fluid medium upwardly through the said particulate electrode, wherein a wall which forms part of a compartment defining the area occupied by the particulate electrode is provided with stabilising means positioned so as to provide generally unidirectional flow channels which, when the electrochemical cell is in use, encourage vertical flow, and discourage bulk lateral movement, of said particles in the region of the said wall.

21. An electrochemical cell as claimed in claim 20, wherein said stabilising means comprise a plurality of ribs which are raised from the general surface level of the said wall.

22. An electrochemical cell as claimed in claim 21, wherein said ribs are triangular in cross-section.

23. An electrochemical cell as claimed in claim 21, wherein said ribs are in the form of a series of linear, parallel strips.

24. An electrochemical cell as claimed in claim 21, wherein said ribs are sinuous in configuration.

25. An electrochemical cell as claimed in claim 21, wherein said ribs are of uniform length and are equally spaced apart.

26. An electrochemical cell as claimed in claim 21, wherein there are a series of generally vertically extending ribs arranged in rows one row above another, the ribs of each row being vertically offset with respect to the ribs of adjacent rows.

27. An electrochemical cell as claimed in claim 21, wherein the strips of material which constitute said ribs are formed with chamfered ends.

28. An electrochemical cell as claimed in claim 20, wherein said wall is an electrochemically inactive wall.

29. An electrochemical cell as claimed in claim 20, wherein said wall includes the current conductor.

30. An electrochemical cell as claimed in claim 20, wherein said wall is adjacent to the current conductor.

31. An electrochemical cell as claimed in claim 20, wherein said stabilising means extend over a major proportion of the height of said wall.

32. An electrochemical cell as claimed in claim 20, in which the particulate electrode is bounded on one side by a separator having an ion-permeable wall and on the side opposite said one side by said wall which is provided with the stabilising means.

33. An electrochemical cell as claimed in claim 20, wherein the means for flowing fluid upwardly through said particulate electrode include a flow distributor through which electrolyte is introduced into the compartment containing the particulate electrode, which flow distributor comprises a plurality of orifices.

34. An electrochemical cell including a particulate electrode and a current conductor for feeding current to the particles of the particulate electrode, and means for flowing a fluid medium upwardly through the said particulate electrode, wherein the particulate electrode is bounded on one side by a separator having an ion-permeable wall and on the side opposite said one side by a wall which is provided with stabilising means comprising a plurality of ribs which are raised from the general surface level of the said wall and are positioned so as to provide generally unidirectional flow channels which, when the electrochemical cell is in use, encourage vertical flow, and discourage bulk lateral movement, of said particles in the region of the said wall.

35. An electrochemical cell as claimed in claim 34, wherein said ribs are in the form of a series of linear, parallel strips.

36. An electrochemical cell as claimed in claim 35, wherein the ribs are of uniform length and are equally spaced apart.

37. An electrochemical cell as claimed in claim 36, wherein the means for flowing fluid upwardly through said particulate electrode includes a flow distributor through which electrolyte is introduced into the compartment containing the particulate electrode, which flow distributor comprises a plurality of uniformly spaced orifices, the spacing between adjacent ribs on the wall being approximately twice that between adjacent orifices in the flow distributor.

38. An electrochemical cell as claimed in claim 34, wherein said stabilising means extend over a major proportion of the height of said wall.

39. An electrochemical cell as claimed in claim 34, wherein said ribs are triangular in cross-section and have chamfered ends.

40. An electrochemical cell as claimed in claim 34, wherein said ribs are sinuous in configuration.

41. An electrochemical cell as claimed in claim 34, wherein there are a series of generally vertically extending ribs arranged in rows one above the other, the ribs of each row being vertically offset with respect of the ribs of adjacent rows.

* * * * *